US011006704B2

(12) United States Patent
Nicolas et al.

(10) Patent No.: US 11,006,704 B2
(45) Date of Patent: May 18, 2021

(54) WATCH BRACELET

(71) Applicant: Omega S.A., Biel/Bienne (CH)

(72) Inventors: Cedric Nicolas, Neuchatel (CH); Dimitri Fostinis, Moutier (CH)

(73) Assignee: Omega S.A., Biel/Bienne (CH)

( * ) Notice: Subject to any disclaimer, the term of this patent is extended or adjusted under 35 U.S.C. 154(b) by 445 days.

(21) Appl. No.: 15/780,377

(22) PCT Filed: Nov. 30, 2016

(86) PCT No.: PCT/EP2016/079174
§ 371 (c)(1),
(2) Date: May 31, 2018

(87) PCT Pub. No.: WO2017/102319
PCT Pub. Date: Jun. 22, 2017

(65) Prior Publication Data

US 2018/0352912 A1 Dec. 13, 2018

(30) Foreign Application Priority Data

Dec. 15, 2015 (EP) ..... 15200087

(51) Int. Cl.
*A44C 5/14* (2006.01)
*A44C 5/00* (2006.01)
(Continued)

(52) U.S. Cl.
CPC ..... *A44C 5/14* (2013.01); *A44C 5/0007* (2013.01); *G04B 47/066* (2013.01); *G04G 17/04* (2013.01);
(Continued)

(58) Field of Classification Search
CPC ..... A44C 5/0007; A44C 5/14; G04B 47/06; G04B 47/066; G04G 17/04; G04G 17/06;
(Continued)

(56) References Cited

U.S. PATENT DOCUMENTS 3,681,587 A 8/1972 Brien
4,178,751 A 12/1979 Liautaud
(Continued)

FOREIGN PATENT DOCUMENTS

EP 1 544 696 A2 6/2005
EP 2 560 303 A1 2/2013
(Continued)

OTHER PUBLICATIONS

Szondy, D, "Kairos TBand turns almost any watch into a smartwatch", Nov. 24, 2014, pp. 1-3, XP05526203, Retrieved from the Internet, URL: http://www.gizmag.com/kairos-tband/34811/.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A bracelet or strap for a watch case includes a first arm, inside which is housed a first printed circuit board portion, and a second arm, the first printed circuit board portion carrying at least one electronic component arranged to perform a corresponding electronic function, and a rigid electrical energy source and a microcontroller for powering and controlling the electronic component arranged to perform a corresponding electronic function, an actuating element, such as a push-button for inputting a control signal into the microcontroller being arranged above the rigid electrical energy source.

14 Claims, 12 Drawing Sheets

(51) Int. Cl.

| | |
|---|---|
| ***G04B 47/06*** | (2006.01) |
| ***G04G 17/08*** | (2006.01) |
| ***G04G 19/00*** | (2006.01) |
| ***G04G 17/04*** | (2006.01) |
| ***G04G 17/06*** | (2006.01) |
| ***G04G 21/08*** | (2010.01) |

(52) U.S. Cl.
CPC ..... *G04G 17/06* (2013.01); *G04G 17/08* (2013.01); *G04G 19/00* (2013.01); *G04G 21/08* (2013.01)

(58) Field of Classification Search
CPC ..... G04G 17/08; G04G 19/00; G04G 21/08; G04G 21/02
See application file for complete search history.

(56) References Cited

U.S. PATENT DOCUMENTS

| | | | | |
|---|---|---|---|---|
| 4,471,819 | A | 9/1984 | Nihashi | |
| 4,972,394 | A | 11/1990 | DiMarco | |
| 6,619,936 | B2 | 9/2003 | Silvant et al. | |
| 2001/0043514 | A1 | 11/2001 | Kita | |
| 2001/0050883 | A1 | 12/2001 | Farine et al. | |
| 2012/0194976 | A1 | 8/2012 | Golko et al. | |
| 2014/0174958 | A1* | 6/2014 | Martinez | A61B 5/7405 206/37 |
| 2014/0194061 | A1 | 7/2014 | Fine | |
| 2014/0313128 | A1 | 10/2014 | Golko et al. | |
| 2016/0070234 | A1* | 3/2016 | Lee | A44C 5/0007 368/282 |
| 2016/0324470 | A1* | 11/2016 | Townsend | A61B 90/98 |
| 2017/0360162 | A1* | 12/2017 | Kawabata | A61B 5/1118 |

FOREIGN PATENT DOCUMENTS

| | | | |
|---|---|---|---|
| EP | 2 940 534 | A1 | 11/2015 |
| FR | 2 641 092 | A1 | 6/1990 |
| JP | 60-151579 | A | 8/1985 |
| JP | 2003-324396 | A | 11/2003 |
| WO | WO 01/35173 | A1 | 5/2001 |
| WO | WO 2015/107523 | A1 | 7/2015 |

OTHER PUBLICATIONS

International Search Report dated Jan. 12, 2017 in PCT/EP2016/079174 filed Nov. 30, 2016.

* cited by examiner

WATCH BRACELET

CROSS-REFERENCE TO RELATED APPLICATIONS

This application is a United States national phase application of International Patent Application No. PCT/EP2016/079174, on filed Nov. 30, 2016, which designates the United States, and claims priority to European Patent Application No. 152000871, filed on Dec. 15, 2015. The entire contents of each of the above applications are hereby incorporated herein by reference in entirety.

FIELD OF THE INVENTION

The present invention concerns a watch bracelet or strap. More specifically, the invention concerns a watch bracelet in which are housed one or more electronic components arranged to perform at least one electronic function.

BACKGROUND OF THE INVENTION

There is a strong trend in the current market relating to connected watches having one or more electronic functions and capable of communicating, for example, with mobile telephones of the smart phone type. In the case of connected watches, the emphasis is, however, placed more on the range of electronic functions that such watches offer their users than on the aesthetic, timekeeping and sealing qualities of such watches.

The connected watches currently available on the market are thus unattractive and relatively fragile objects whose daily use requires a great deal of care on the part of the user.

Among available electronic functions, it may be envisaged to provide a pressure sensor allowing the user to store dive parameters (dive time, depth reached, temperatures), and then to save the history of his dive in a smart phone or in a personal computer. The pressure sensor may be housed inside the watch bracelet, to avoid having to modify the watch case that houses a timepiece movement, which might be mechanical, electronic or electromechanical. The watch case thus maintains all its aesthetic, impermeable and timekeeping properties, while offering the user additional electronic functions, thanks to the addition of the bracelet of the invention.

Of course, at least one energy source must be housed inside the bracelet, for the electrical power supply of the various electronic components required to perform the electronic function or functions.

Likewise, it is necessary to equip the bracelet with at least one touch or voice interface device to allow the user to interact with the electronic functions. This may be, for example, a push-button allowing the user to stop and start a particular electronic function. Yet this latter point poses a problem. Indeed, it is understood that, to start and stop an electronic function by means of a push-button, the user must exert a pressure on the latter. However, bracelets inside which are housed the various components required to perform electronic functions, are typically made using plastic material or elastomer. These bracelets are therefore flexible and do not provide a sufficiently rigid support surface to exert a reaction force in response to the pressure exerted by the user to actuate the push-button. When the user presses the push-button, the flexible bracelet will deform and the user cannot therefore be sure to have actuated the push-button properly, which is unacceptable.

SUMMARY OF THE INVENTION

It is an object of the present invention to overcome the aforementioned problems in addition to others, by providing a bracelet or strap that will make it possible to associate with a watch case one or more electronic functions controlled by means of a push-button.

To this end, the present invention concerns a bracelet for a watch case comprising a first arm inside which is housed a first printed circuit board portion, and a second arm, the first printed circuit board portion carrying at least one electronic component arranged to perform a corresponding electronic function, and an electrical energy source and a microcontroller for powering and controlling the electronic component arranged to perform a corresponding electronic function, at least one pushbutton for inputting a control signal into the microcontroller being arranged inside the bracelet above a rigid surface offering a support surface which, in response to a pressure exerted on the actuating element, exerts a reaction force sufficient to ensure that the pressure exerted on the actuating element is not at least partially compensated by corresponding deformation of the bracelet, the first arm being connected to the second arm via a median part arranged to be situated underneath the watch case, a second printed circuit board portion housed inside the second arm and carrying at least one other electronic component being connected to the first printed circuit board portion housed inside the first arm via the median part, which includes a third printed circuit board portion connected to the first and second printed circuit board portions by electrical connecting means.

According to a complementary feature of the invention, the rigid surface is formed by the electrical energy source.

According to a second embodiment of the invention, the bracelet for a watchcase includes a folding buckle clasp, a first arm, inside which is housed a first printed circuit board portion, and a second arm, the first printed circuit board portion carrying at least one electronic component arranged to perform a corresponding electronic function, and an electrical energy source and a microcontroller for powering and controlling the electronic component arranged to perform a corresponding electronic function, at least one push-button for inputting a control signal into the microcontroller being arranged inside the bracelet above the folding buckle clasp offering a support surface which, in response to a pressure exerted on the actuating element, exerts a reaction force sufficient to ensure that the pressure exerted on the actuating element is not at least partially compensated by corresponding deformation of the bracelet.

As a result of these features, the present invention provides a bracelet for a watch case inside which are housed electronic components such as, in particular, a push-button arranged above a rigid surface which thus provides a support surface which exerts a reaction force in response to depression of the push-button by the user, which allows the user to be sure that he has properly pressed the push-button and that account has been taken of his instruction. Since the printed circuit sheets are disposed in the two bracelet strands and these printed circuit sheets are also electrically connected to each other, it is possible to provide a push-button in each bracelet strand and, via appropriate combinations of pressures on these push-buttons, to increase considerably the number of functions it is possible to control by means of the microcontroller. This also allow to increase the number of electronic components housed inside the bracelet and thus to increase the number of electronic functions available to the user, or to distribute the electronic components in an optimum manner between the two bracelet strands.

According to a complementary feature of the invention, the rigid surface is formed by the electrical energy source above which the push-button is arranged.

Alternatively, the bracelet according to the invention is provided with a deployant buckle clasp which provides a rigid support surface, above which is arranged a push-button. As a result of this arrangement, the push-button is located opposite the watch-case. It is thus enough that the user turns his wrist 180° so that he finds the push-button. It is a simple gesture that can be done in all circumstances and especially in the dark. As a result of the presence of the push-button, the user will be able to input control signals into the microcontroller. To this end, the microcontroller can be programmed to distinguish between a short press and a long press on the push-button, or between a single press and a double press.

According to one embodiment of the invention, the rigid electrical energy source is a button cell battery According to one embodiment of the invention, the button cell battery is arranged in the area of connection of the bracelet to the watch case.

According to yet another embodiment of the invention, the push-button consists of a dome-shaped flexible metal sheet, the dome presenting a periphery that bears on a first contact provided on the first printed circuit board portion, and a peak which, when the user presses the push-button, deforms and bears on a second contact, provided on the first printed circuit board portion, which sends a signal to the microcontroller.

A "rigid energy source" means an energy source that offers a support surface which, in response to a pressure exerted on a push-button, exerts a reaction force sufficient to ensure that the pressure exerted by the user on the push-button is not at least partially compensated by corresponding deformation of the flexible bracelet.

If the bracelet is worn out or if the electrical energy source that it contains is exhausted, it can easily be exchanged for a new bracelet. Of course, according to a variant, the electrical energy source may also be rechargeable or replaceable.

BRIEF DESCRIPTION OF THE DRAWINGS

Other features and advantages of the present invention will appear more clearly from the following detailed description of one embodiment of the bracelet according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea which consists in associating a watch case containing a watch movement, preferably but not limited to a mechanical movement, with a bracelet or strap, in the thickness of which are housed at least one electrical energy source and a microcontroller for powering and controlling at least one electronic component arranged to perform a corresponding electronic function. As a result of the presence of an actuating element, such as a push-button, the user will be able to input control signals into the microcontroller. To this end, the present invention requires the push-button to be arranged above a rigid surface which may, for example, be formed by the electrical energy source or by a folding buckle clasp comprised in the bracelet. Due to its rigidity, the rigid surface provides the push-button with a support surface that exerts a reaction force in response to depression of the push-button by the user, which allows the user to be sure that he has properly pressed the push-button and that account has been taken of his instruction. It is understood that, if the push-button were not arranged above a rigid surface, but simply embedded in the thickness of the bracelet made of a conventional flexible material, such as plastic or elastomer, the bracelet would deform under the effect of the pressure exerted on the push-button, which would at least partly compensate for the force exerted by the user on the push-button and would prevent the user from being sure that the push-button had been properly actuated and that the control signal had been sent to the microcontroller.

Figure 1:
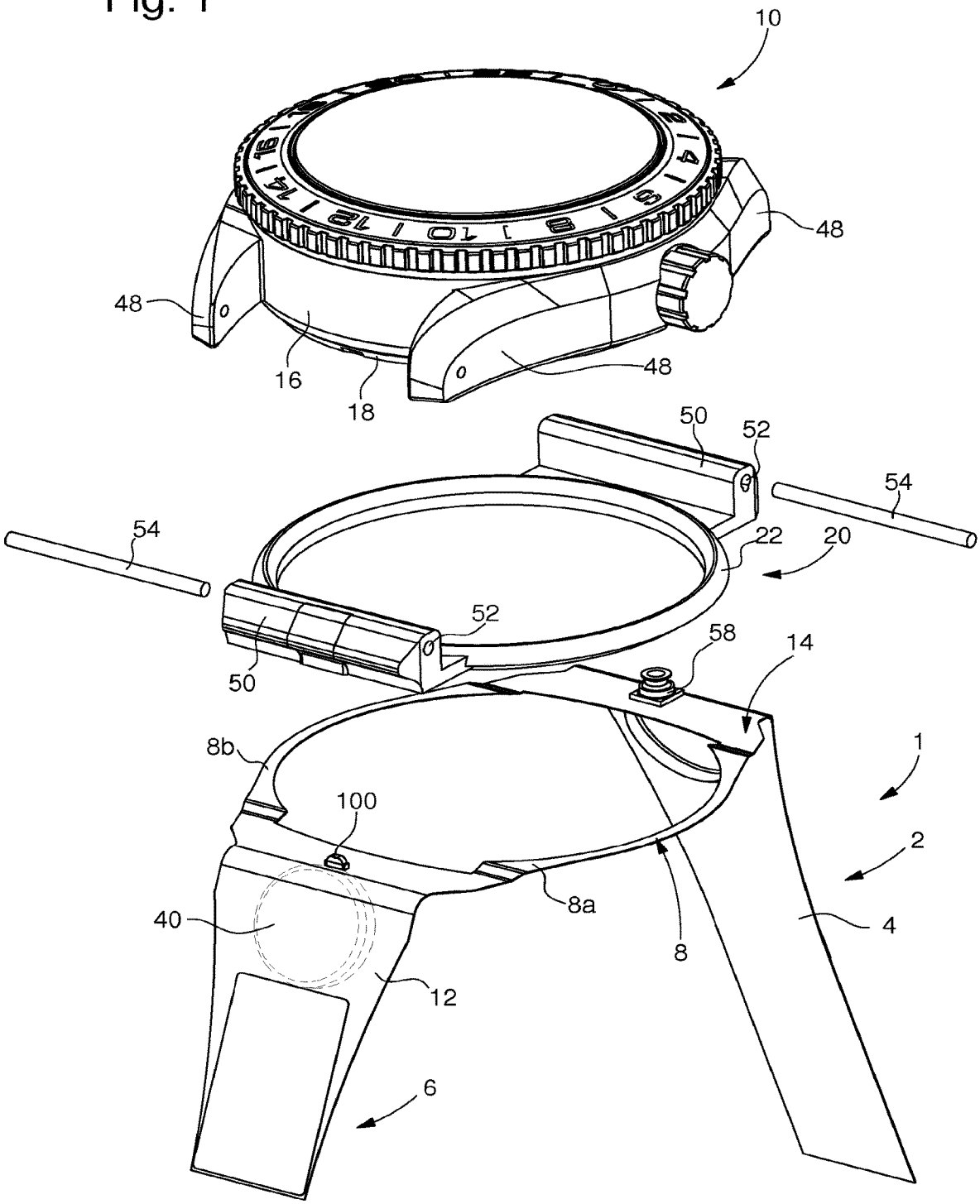
FIG. 1 is a perspective view of the bracelet according to the invention in an unassembled state, wherein a first printed circuit sheet is connected to a second printed circuit sheet via a median part arranged to be situated underneath a watch case, this median part including means for ensuring electrical continuity between the first printed circuit sheet and the second printed circuit sheet and being covered by a rigid insert which serves as a seat for the watch case.

FIG. 1 is a perspective view of the bracelet of the invention in an unassembled state. Designated as a whole by the general reference numeral 1, this bracelet comprises a first arm 2, inside which is housed a first printed circuit board portion 4, and a second arm 6 connected to first arm 2 by a median part 8 that is arranged to be underneath a watch case 10.

According to one embodiment of the invention, the watch bracelet has only one printed circuit board portion housed inside one or other of the two bracelet arms. However, in a preferred variant embodiment of the invention which will be described below, printed circuit board portions are housed in both of the two bracelet arms and are connected to each other by the median part. It will be understood upon reading the following description that this preferred variant of the invention makes more printed circuit board surface area available for mounting a larger number of electronic components and electrical energy sources, which makes it possible to offer the user more electronic functions and better autonomy.

Thus, second arm 6 includes a second printed circuit board portion 12 connected to first printed circuit board portion 4 by electrical connecting means which ensure electrical continuity between first printed circuit board portion 4 and second printed circuit board portion 12.

Second printed circuit board portion 12 could be electrically separate from first printed circuit board portion 4. In such case, it would, however, be necessary to provide electrical connecting means between first printed circuit board portion 4 and second printed circuit board portion 12, such as wires, which is not necessarily very convenient or very secure. This is why, in the preferred embodiment of the invention, a third printed circuit board portion 14 housed inside median part 8 is made in one-piece with the first and second printed circuit board portions 4 and 12 housed inside the first and second arms 2 and 6 of bracelet 1. This third printed circuit board portion 14 includes one or more or electrically conductive paths for ensuring electrical continuity between the first and second printed circuit board portions 4 and 12.

As shown, in particular in FIG. 1, median part 8, which is of approximately annular shape, is formed of two arch portions 8*a* and 8*b* which define an external diameter substantially corresponding to the external diameter of watch case 10, which is delimited by a case middle 16 and a case back 18. Watch case 10 is intended to be arranged above median part 8 with the insertion of an insert 20 between watch case 10 and median part 8. This insert 20 includes a rigid ring 22 whose geometry is similar to that of median part 8 and which is attached to median part 8 by any appropriate means, such as adhesive bonding. This rigid ring 22 gives median part 8 rigidity and mechanical strength and acts as a seat for watch case 10. It is understood that, owing to its ring-shape, median part 8 leaves the case back 18 of watch case 10 visible. It is understood, however, that in the case where it is not desired for case back 18 of watch case 10 to be visible, median part 8 could take the form of a disc obscuring case back 18

Figure 3A:
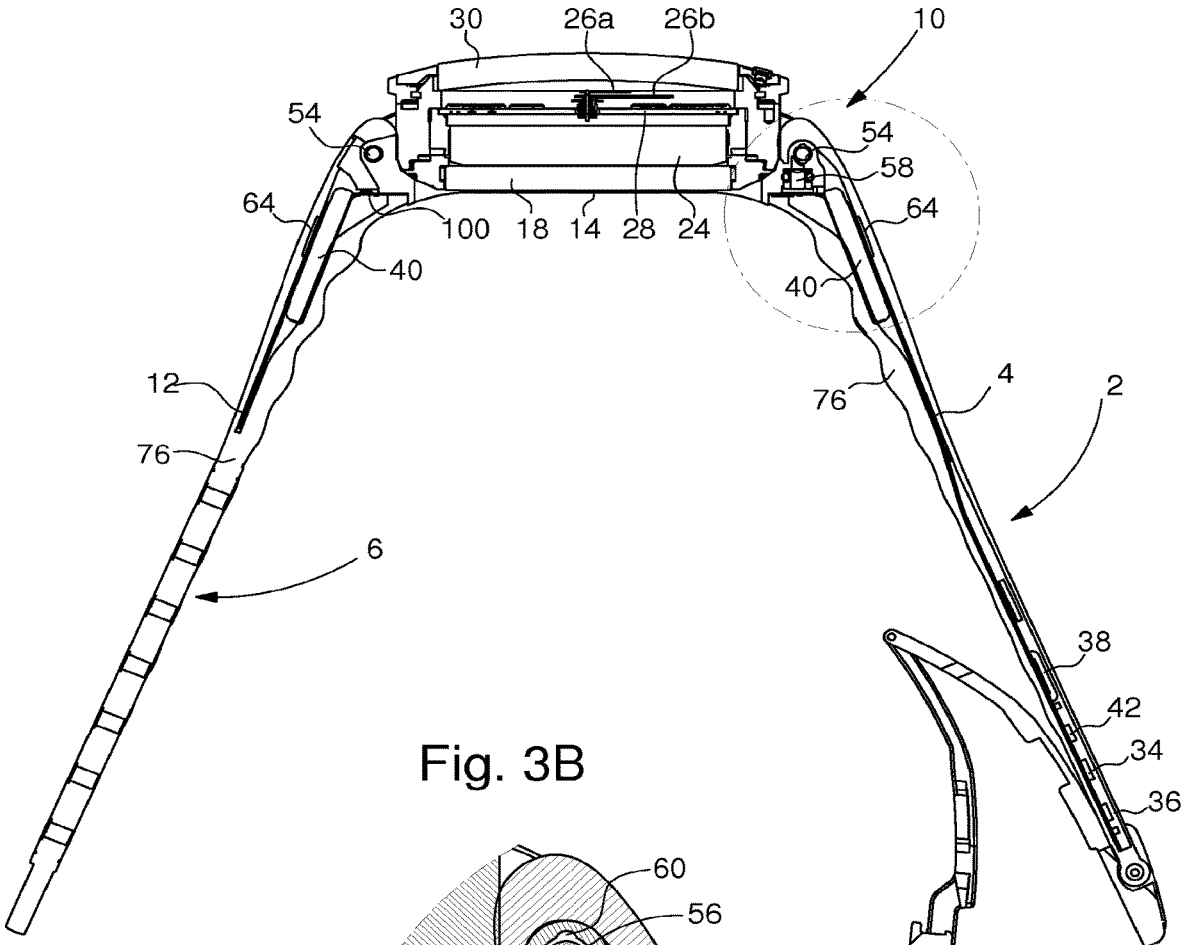
FIG. 3A is a vertical cross-section along the longitudinal axis of the bracelet of FIG. 2.

We will now examine bracelet 1 according to the invention, referring more particularly to FIG. 3A, which is a cross-sectional view on a plane extending along the longitudinal axis of bracelet 1. As shown by this Figure, watch case 10 contains a watch movement 24 which drives a set of hands: hour hand 26*a* and minute hand 26*b*. These hour and minute hands 26*a* and 26*b* move above a dial 28 and are covered by a crystal 30.

It is important to understand that the watch movement 24 housed inside watch case 10 may be of any type. It may be a purely mechanical movement, or a purely electronic movement, or an electromechanical movement. The mechanical or electronic nature of watch movement 24 is actually of no importance for the purposes of the present invention, given that watch case 10 is totally independent of bracelet 1 according to the invention and the addition of such a bracelet 1 does not require any modification of the various components housed inside watch case 10.

It is therefore understood from the foregoing that the present invention is particularly advantageous in the case where watch movement 24 is a mechanical movement. Indeed, the addition of a bracelet 1 of the invention to a watch case 10 containing such a purely mechanical watch movement 24 enables unprecedented electronic functions to be offered to the user, without impairing the aesthetic appearance, mechanical qualities and sealing of watch case 10.

As mentioned above, bracelet 1 according to the invention includes a first arm 2, inside which is housed a first printed circuit board portion 4, and a second arm 6, inside which is housed a second printed circuit board portion 12. Preferably, these first and second printed circuit board portions 4, 12 are made in one-piece with median part 8, which comprises for this purpose a third printed circuit board portion 14, on which are structured the electrically conductive path or paths ensuring electrical continuity between these two printed circuit board portions 4 and 12. Such an arrangement has numerous advantages, among which the following can be mentioned: the possibility of having more electronic components in the bracelet and thus of increasing the number of electronic functions available to the user, or of distributing the electronic components in an optimum manner between the two bracelet strands. It will also be understood that having more space available allows the designer to optimise ergonomics and interactions between the user and the bracelet.

As revealed by an examination of FIG. 3, electronic components, such as a microcontroller 34, an accelerometer 36 and a magnetic sensor 38, are mounted at the surface of first printed circuit board portion 4. This first printed circuit board portion 4 also carries a rigid electrical energy source 40, and an integrated circuit 42 capable of communicating with another device using, for example, a Bluetooth, Wi-Fi or NFC type interface. Likewise, another rigid electrical energy source 40 is mounted at the surface of second printed circuit board portion 12.

One of the poles of rigid electrical energy source 40 is connected to first printed circuit board portion 4 by means of a clamp 44 which is also used for the mechanical holding of electrical energy source 40. A connecting stud 46, structured on first printed circuit board portion 4, connects the other pole of rigid electrical energy source 42 to first printed circuit board portion 4.

An examination of FIG. 1 reveals, in particular, that watch case 10 includes two pairs of diametrically opposite horns 48 and insert 20 includes two guide elements 50 arranged to be placed between the respective pairs of horns 48 when watch case 10 is placed on insert 20. These two guide elements 50 are each pierced with a hole 52 for the passage of a pin 54 for attaching bracelet 1 to watch case 10.

Figure 3B:
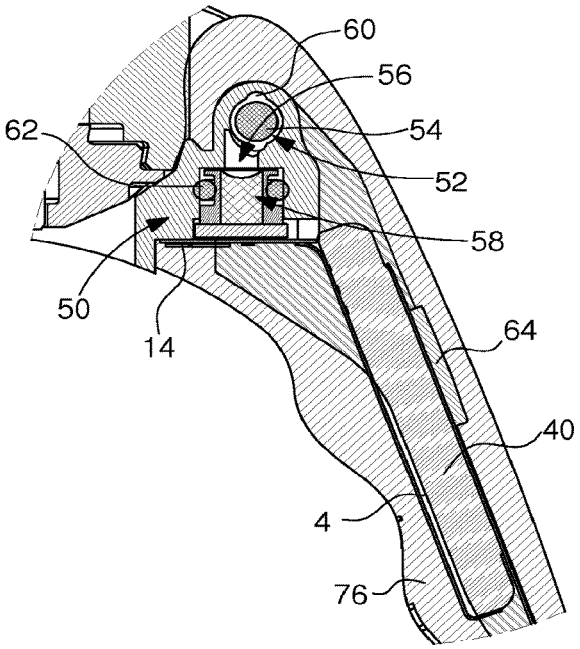
FIG. 3B is a larger scale view of the area surrounded by a circle in FIG. 3A.
Figure 7:
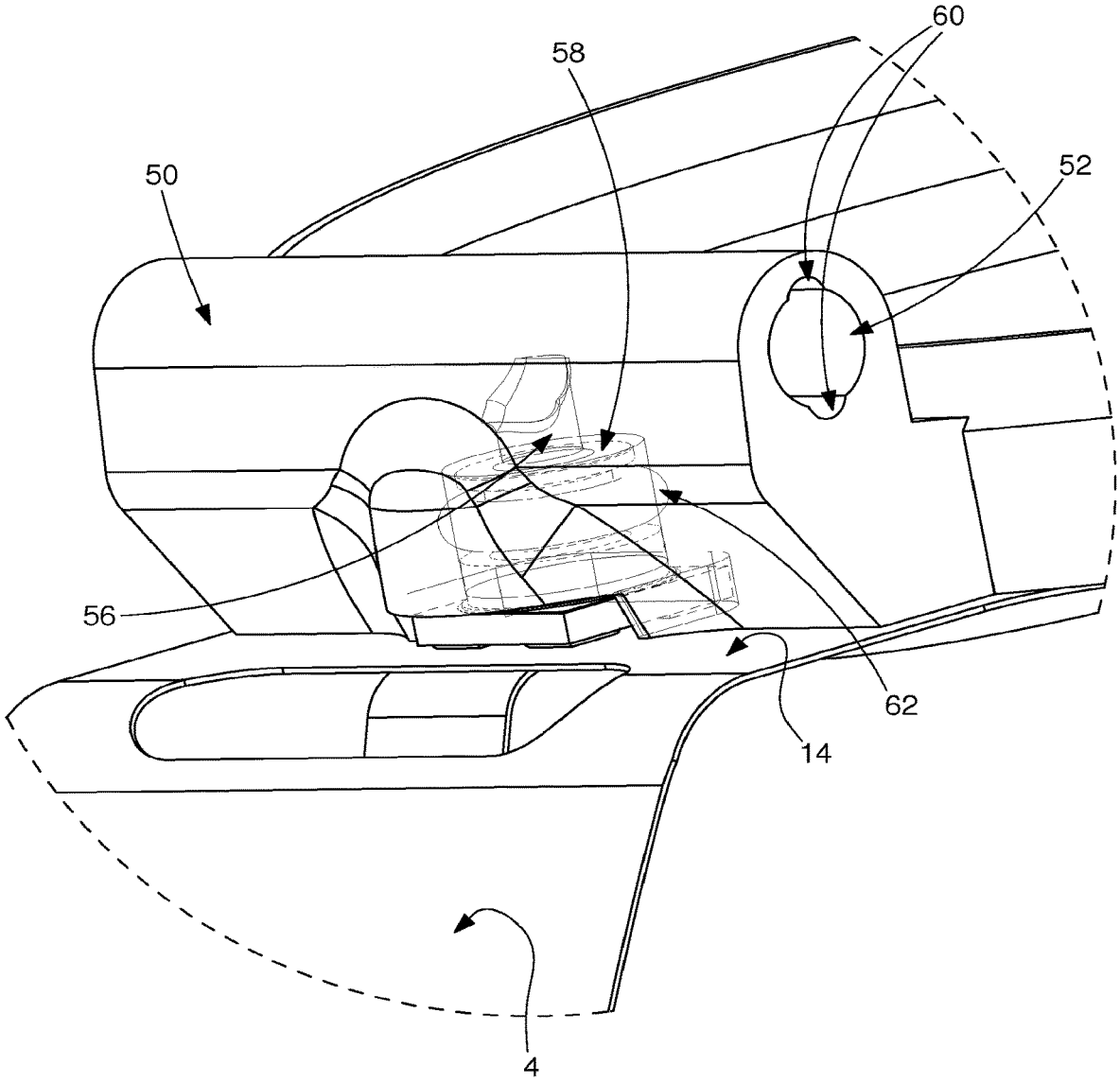
FIG. 7 is a larger scale detailed view of one of the elements for guiding the insert inside which is housed the pressure sensor with insertion of a sealing gasket.

As seen in particular in FIGS. 3B and 7, a housing 56 arranged in the thickness of one of guide elements 50 can accommodate pressure sensor 58. This housing 56 opens on one side on median part 8, to allow pressure sensor 58 to be fixed to third printed circuit portion 14 and to be connected to microcontroller 34, and on the other side into hole 52 for the passage of pin 54, to place pressure sensor 58 in communication with water. Indeed, it is seen that hole 52 for the passage of pin 54 has a local increase in diameter 60 which does not hinder proper guiding of pin 54, but which creates a path for bringing water into contact with pressure sensor 58. A simple sealing gasket 62 seals housing 56 and efficiently isolates the electronic components housed inside bracelet 1 from water. Moreover, because pressure sensor 58 is disposed inside a rigid housing 56, there is no risk of the pressure measurement system being damaged due to the deformations to which bracelet 1 is subjected when it is worn on the user's wrist. Pressure sensor 58 is, for example, the sensor marketed by Measurement Specialities Inc. under the reference MS5837-30BA. This is a piezoresistive pressure sensor whose pressure sensing element is formed by stress gauges mounted in a Wheatstone bridge to maximise the sensor output signal and minimise its sensitivity to measurement error.

According to one embodiment of the invention, an actuating element, such as a push-button 64 is arranged in bracelet 1 above at least one of rigid electrical energy sources 40, which are, by way of preferred but non-limiting example, button cell batteries. Due to its rigidity, electrical energy source 40 provides push-button 64 with a support surface which exerts a reaction force to the pressure exerted by the user on push-button 64. Consequently, push-button 64 is not depressed into the flexible material, for example plastic or elastomer, of which bracelet 1 is made, and the pressure exerted by the user is transmitted in full to push-button 64. The user is thus ensured that his instruction has been taken into account.

Push-button 64 is used to input a control signal into microcontroller 34, for example to start operating pressure sensor 58, or to transfer data stored by pressure sensor 58 to another device via integrated circuit 42. To this end, microcontroller 34 is programmed to be capable of distinguishing, for example, between a short press and a long press, or between a single press and a double press. If bracelet 1 according to the invention is equipped with two push-buttons 64, it is also possible to envisage microcontroller 34 being controlled by a combination of pressures exerted alternately on both of the two push-buttons 64.

By way of preferred but non-limiting example, push-button 64 consists of a dome-shaped flexible metal sheet 66, dome 66 having four equidistant arms 68 bearing on a first contact 70 provided on first printed circuit board portion 4, and a peak 72, which when the user presses push-button 64, deforms and bears on a second contact 74, also provided on first printed circuit board portion 4, which allows a signal to be sent to microcontroller 34. Preferably, push-button 64 is held on first printed circuit board portion 4 by means of an adhesive sheet 75. As can be seen, in particular, in FIGS. 3A and 3B, the button cell battery is arranged, by way of preferred but non-limiting example, in the area of connection of bracelet 1 to watch case 10. Consequently, the assembly formed by the button cell battery and push-button 64 is arranged in an area of greater rigidity, which ensures even easier actuation of push-button 64 and protects the latter from deformations associated with the bending and twisting motions that allow bracelet 1 to adapt to the shape and to the movements of the user's wrist.

Figure 2:
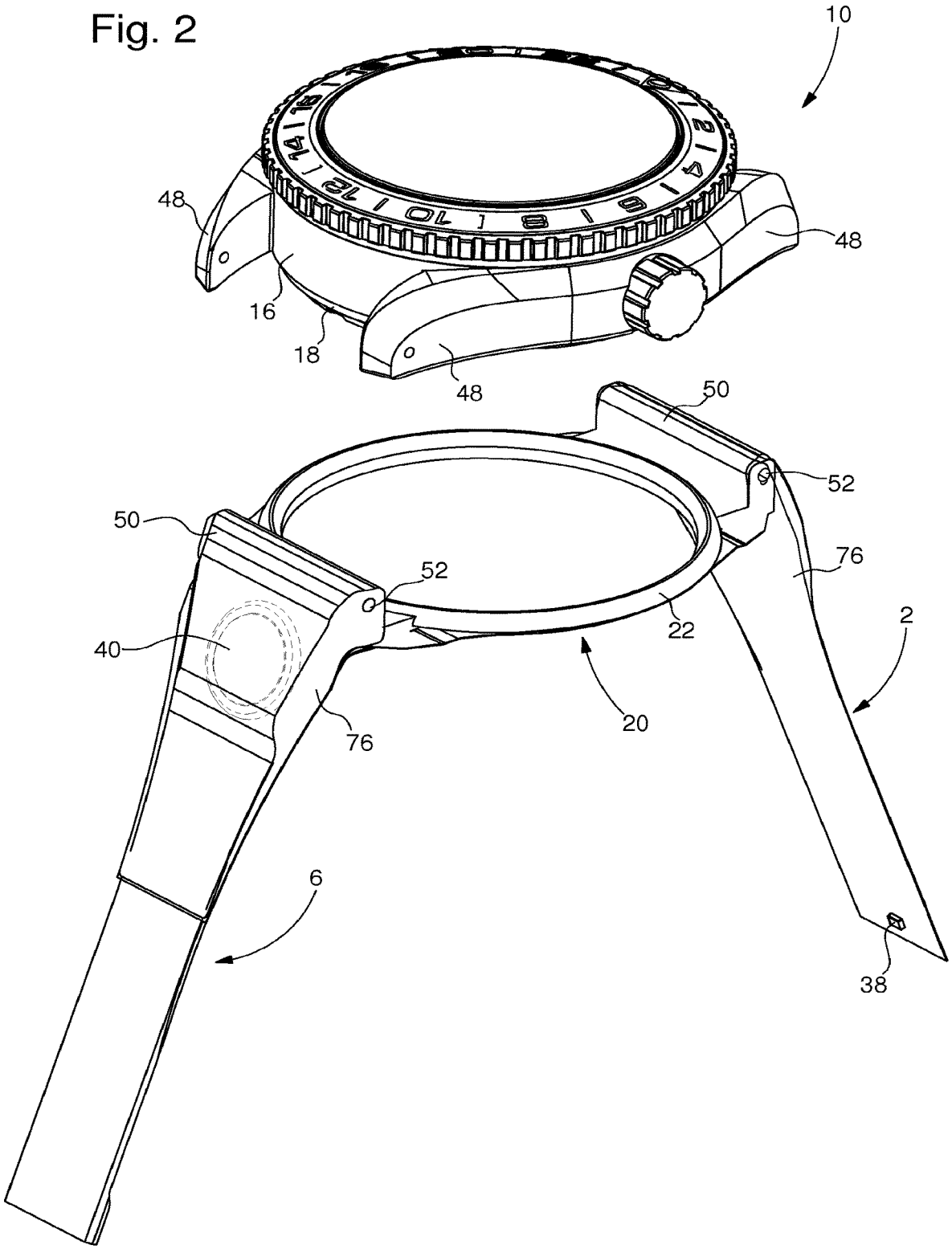
FIG. 2 is a similar view to that of FIG. 1 wherein the first printed circuit sheet and the second printed circuit sheet are overmoulded with a first layer of a plastic or elastomeric material.

When all the electronic components are mounted on printed circuit board portions 4, 12 and 14, and insert 20 has been suitably arranged on median part 8, the assembly is overmoulded with a first layer 76 of plastic or elastomeric material in order to form first and second arms 2 and 6 (see FIG. 2). The purpose of this first overmoulding layer 76 is to protect the electronic components mounted on first and second printed circuit board portions 4, 12 from external aggression and to give the resulting arms 2 and 6 their shape and mechanical strength. Preferably, pins 54 are engaged through horns 48 and guide elements 50 at the time of the overmoulding operation in order to prevent holes 52 being clogged with the overmoulding material.

Figure 4:
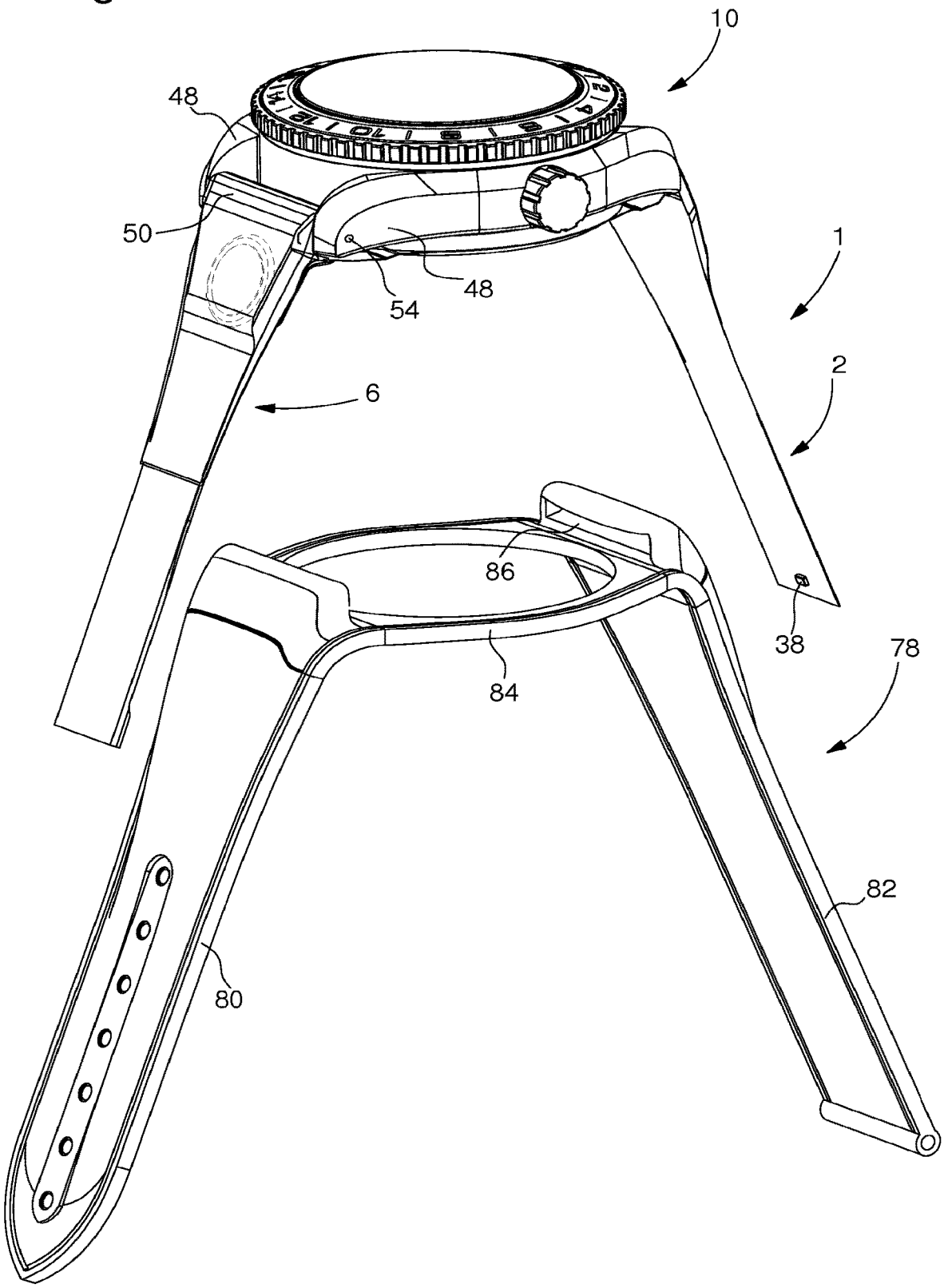
FIG. 4 is a view of a sleeve into which is inserted the bracelet of FIG. 2.
Figure 5A:
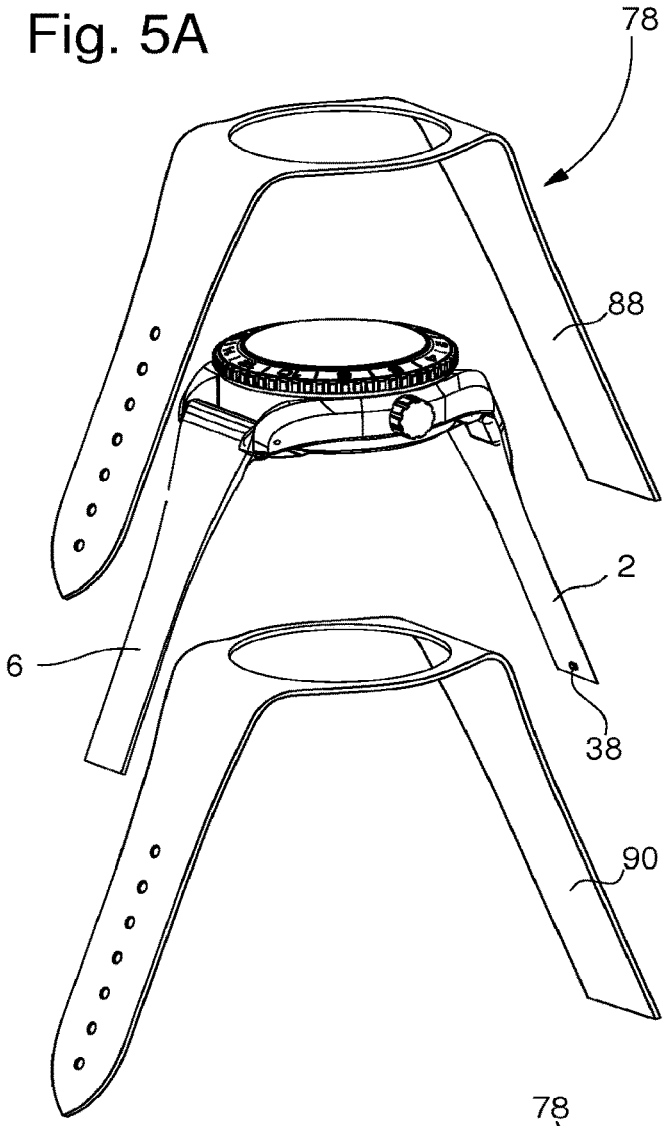
FIGS. 5A and 5B illustrate the case wherein the sleeve of FIG. 4 includes an upper band and a lower band between which is arranged the bracelet according to one embodiment of the invention, and which are assembled to each other along their peripheral edges, for example, by a seam or by heat welding.
Figure 5B:
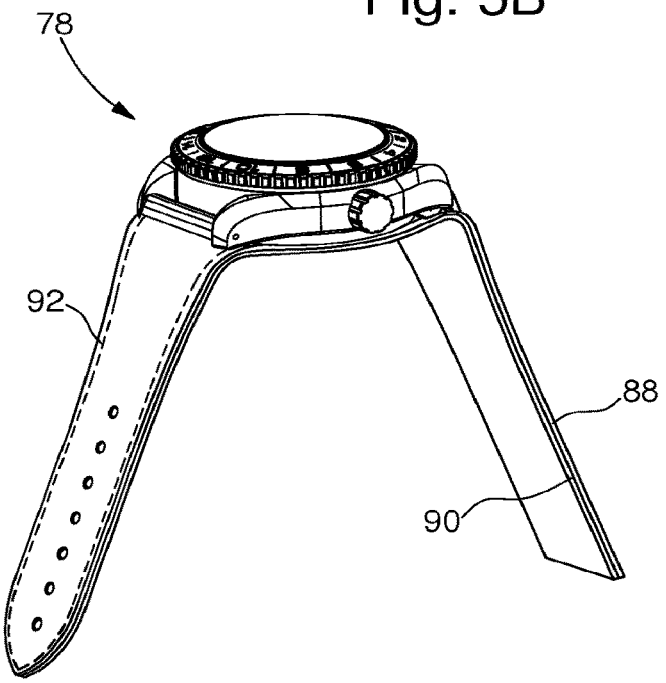

Finally, the bracelet 1 which results from the overmoulding operation and which includes the two arms 2, 6 connected to each other by median part 8 covered by insert 20 and in the thickness of which are housed the electronic components required to perform the desired electronic function or functions, is slipped inside a sleeve 78. In the example represented in FIG. 4, this sleeve 78 includes a first strand 80 and a second strand 82 connected to each other by a connecting part 84 whose shape and dimensions are adapted to accommodate median part 8 of bracelet 1 covered by insert 20. This sleeve 78 is, for example, obtained by moulding or injection moulding an elastomeric material while ensuring that first and second strands 80 and 82 are hollow and each provided with an opening 86 so that the two arms 2 and 6 can slide therein. According to a variant embodiment illustrated in FIGS. 5A and 5B, sleeve 78 includes an upper band 88 and a lower band 90 between which is arranged bracelet 1 according to the invention and which are assembled to each other along their peripheral edges 92, for example, by a seam or by heat welding.

It goes without saying that this invention is not limited to the embodiment that has just been described and that various simple modifications and variants can be envisaged by those skilled in the art without departing from the scope of the invention as defined by the annexed claims.

In particular, as an alternative to sleeve 78, bracelet 1 according to the invention could be subjected to a second overmoulding operation intended to cover the two arms 2, 6 and median part 8 which connects them, with a second layer of a second plastic or elastomeric material, which may be the same or different from the material used for first overmoulding layer 76.

Figure 6:
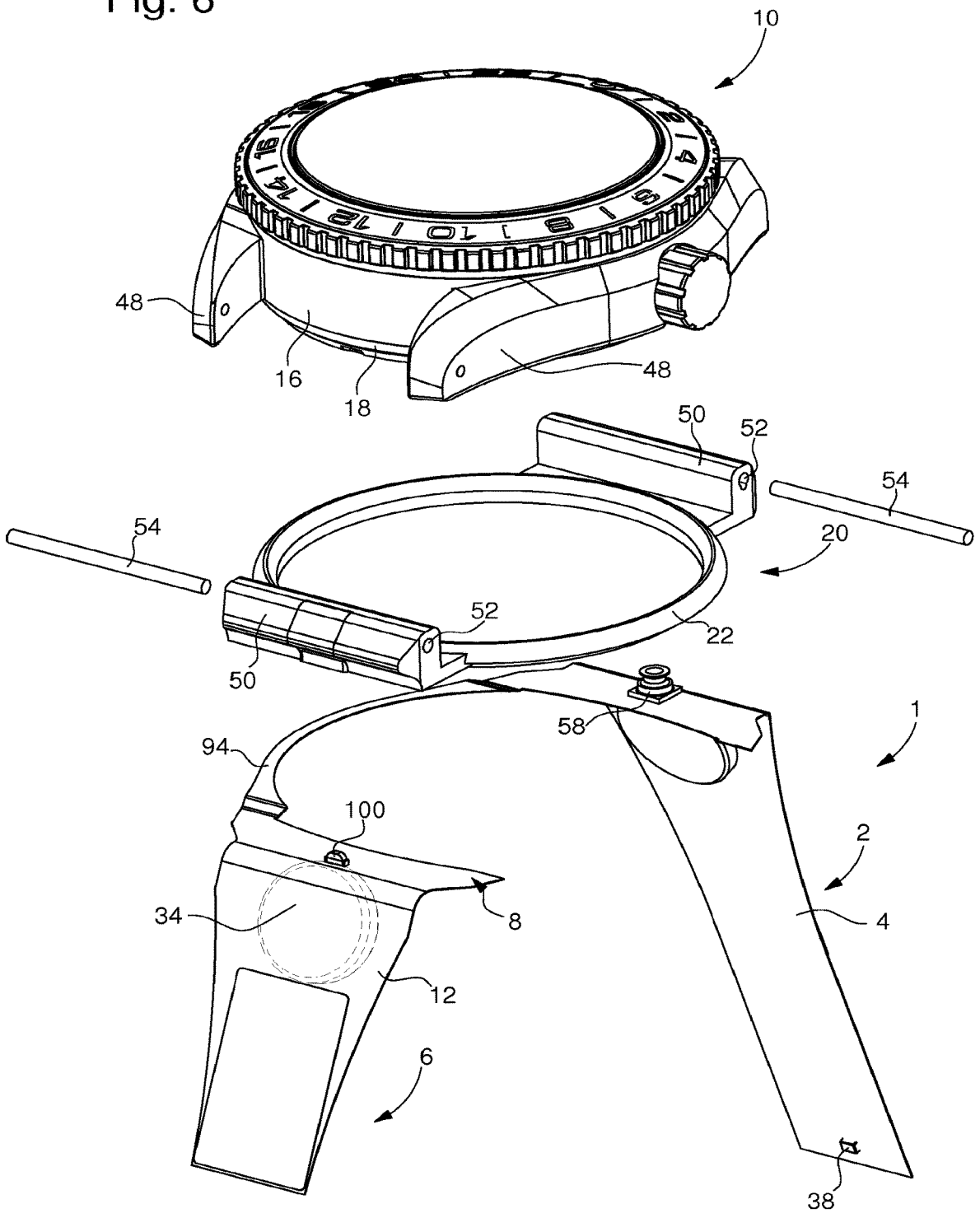
FIG. 6 illustrates the case wherein the median part consists only of an arch portion to carry the conductive paths for electrically connecting the first and second printed circuit board portions to each other.

Also, as illustrated in FIG. 6, median part 8 may have only one arch 94 to carry the conductive paths for electrically connecting first and second printed circuit board portions 4 and 12 to each other.

Figure 8:
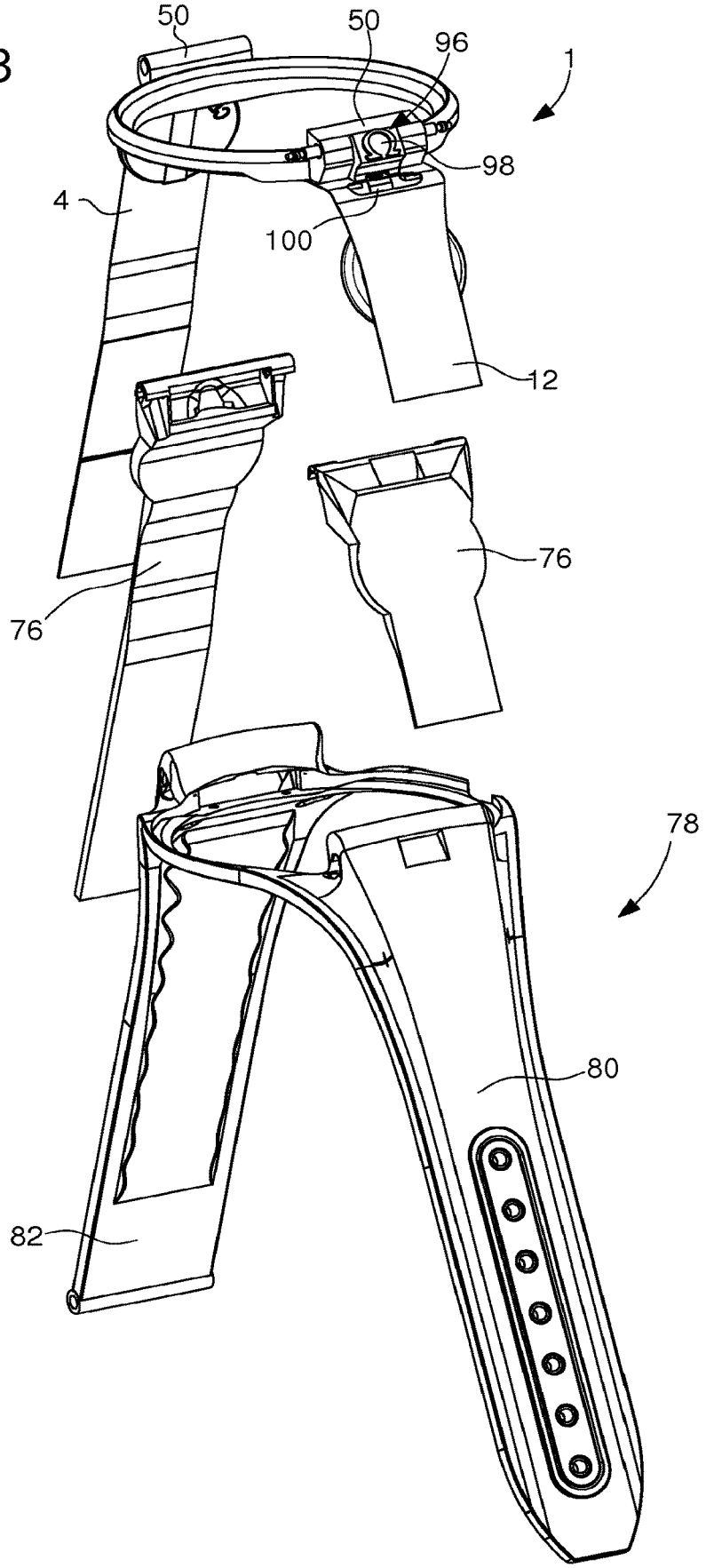
FIG. 8 is a larger scale detailed view of the other guide element inside which is housed a guide for conducting the light produced by a point light source towards the exterior.
Figure 9:
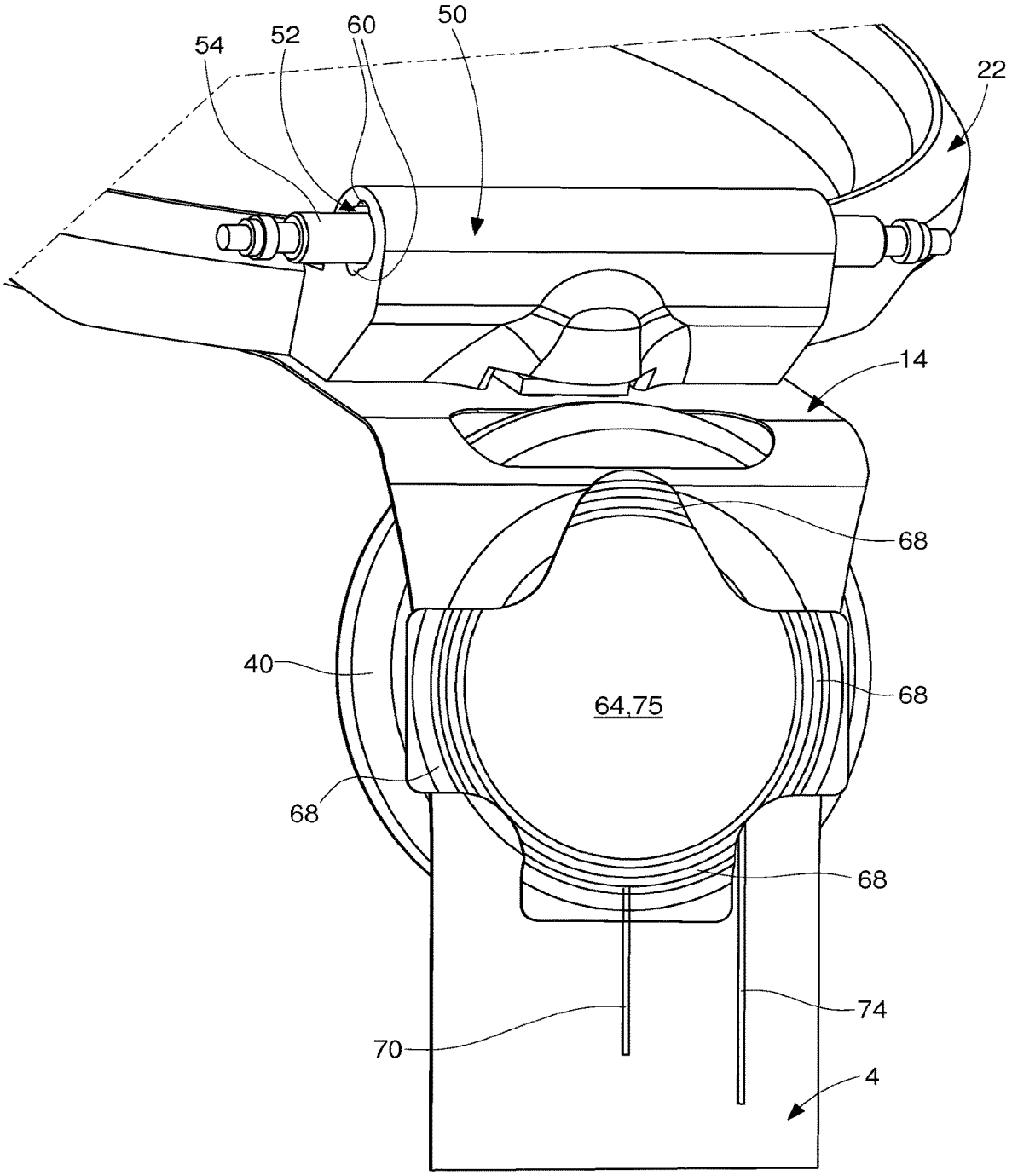
FIG. 9 is a larger scale detailed view of the area where one of the bracelet arms is connected to the watch case and where the button cell battery and push-button are arranged.
Figure 10:
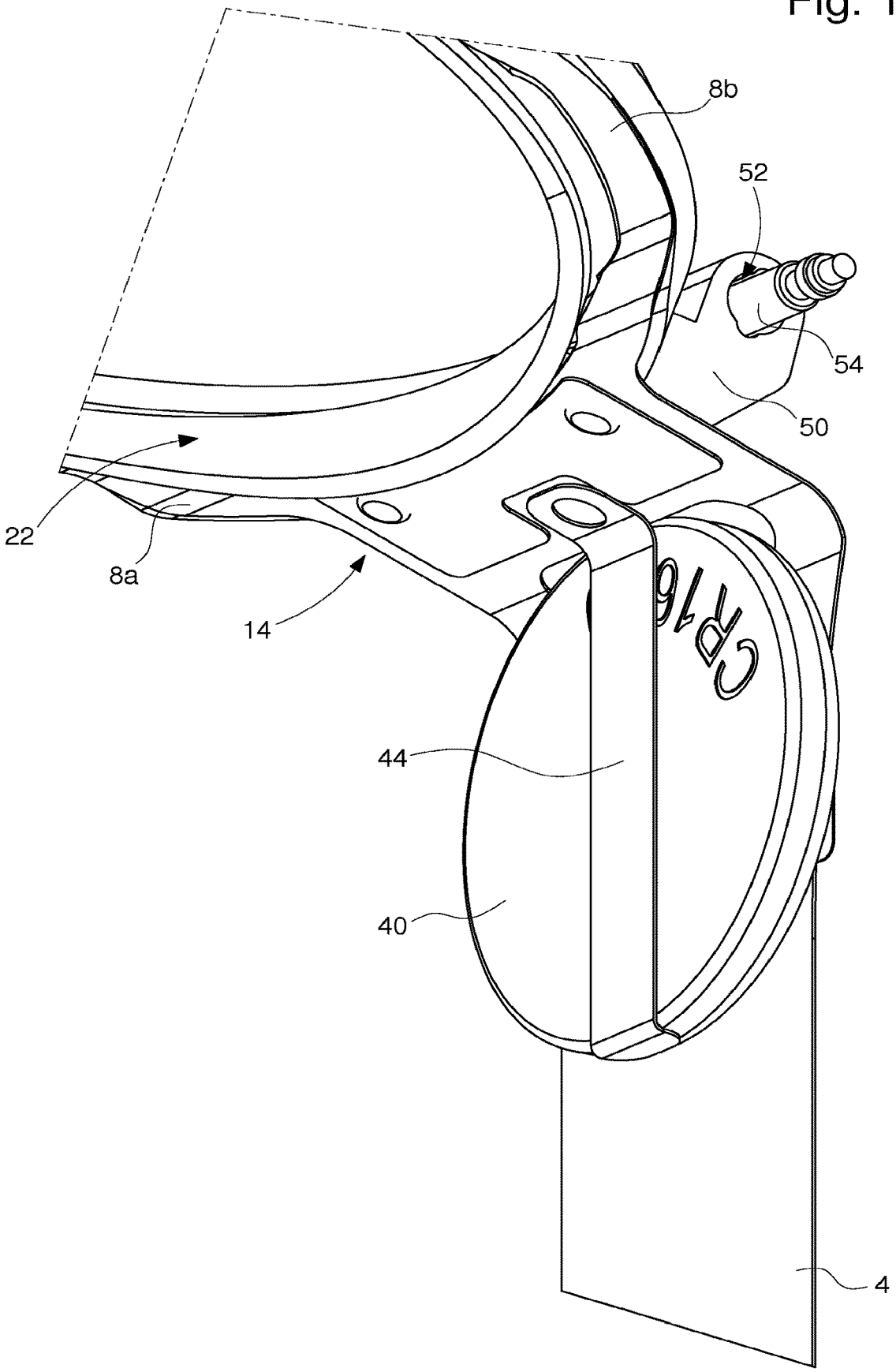
FIG. 10 is a bottom view of the button cell battery seen in FIG. 9.
Figure 11:
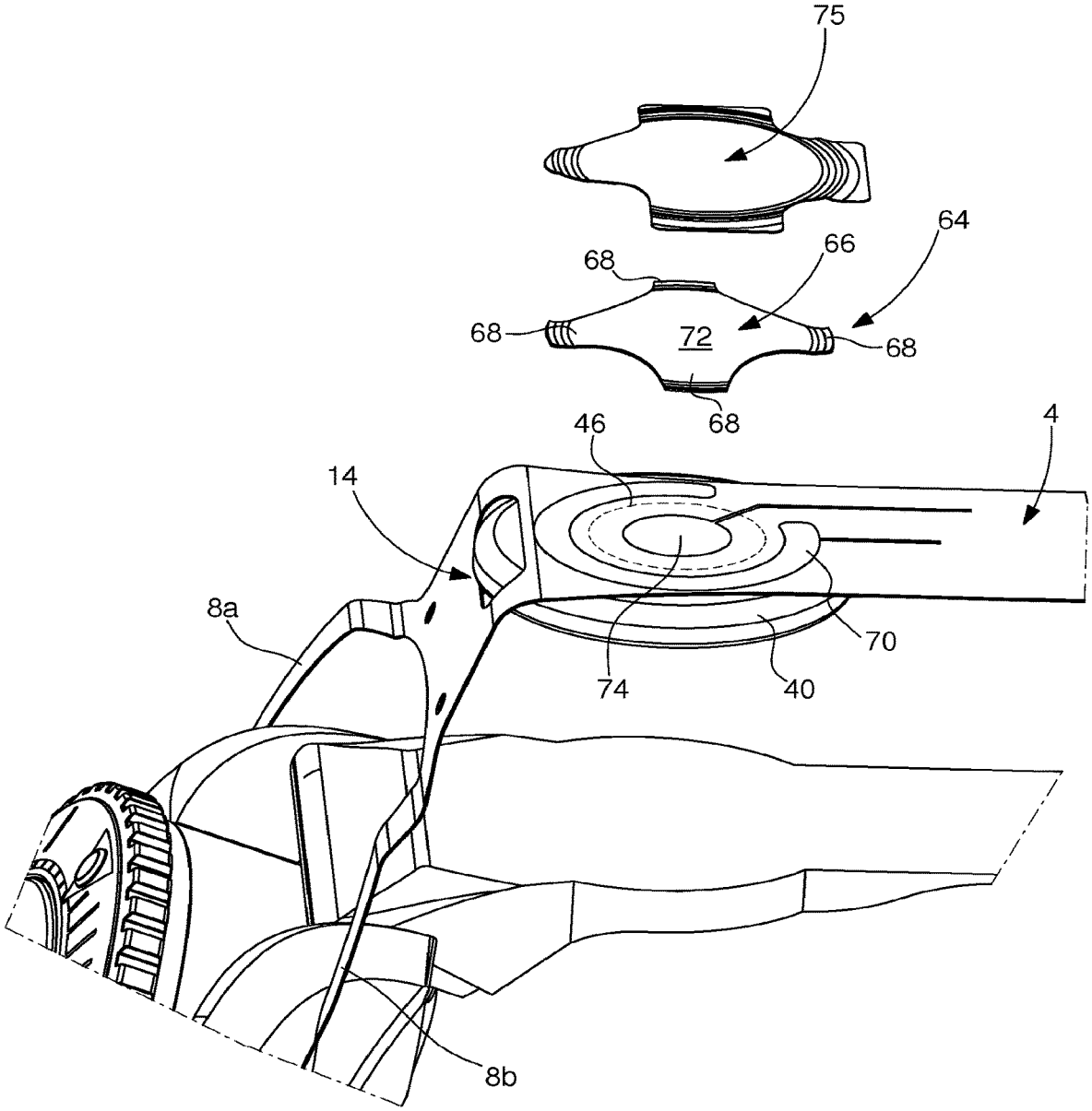
FIG. 11 is a perspective view, in the unassembled state, of the button cell battery, the push-button and the printed circuit board portion on which the button cell battery and push-button are mounted.

It is also noted (see FIG. 8) that a notch 96, provided in whichever guide element 50 that does not accommodate the pressure sensor, can accommodate a transparent light guide 98 underneath which will be disposed a point light source 100, such as a light emitting diode, fixed on second printed circuit board portion 12 and supplied with current by electrical energy source 40. Point light source 100 can indicate the operating state of pressure sensor 58 by means of a colour code.

It will also be noted that several superposed flexible batteries, assembled to each other, can form a rigid electrical energy source within the meaning of the invention.

Likewise, according to a simplified embodiment of the invention, each of the first and second arms 2 and 6 is attached by one of its free ends to watch case 10 and bracelet 1 is closed by attaching first and second arms 2 and 6 to each other via their other free end.

It will also be noted that the actuating element may be a switch that can be switched between two stable positions.

Figure 12:
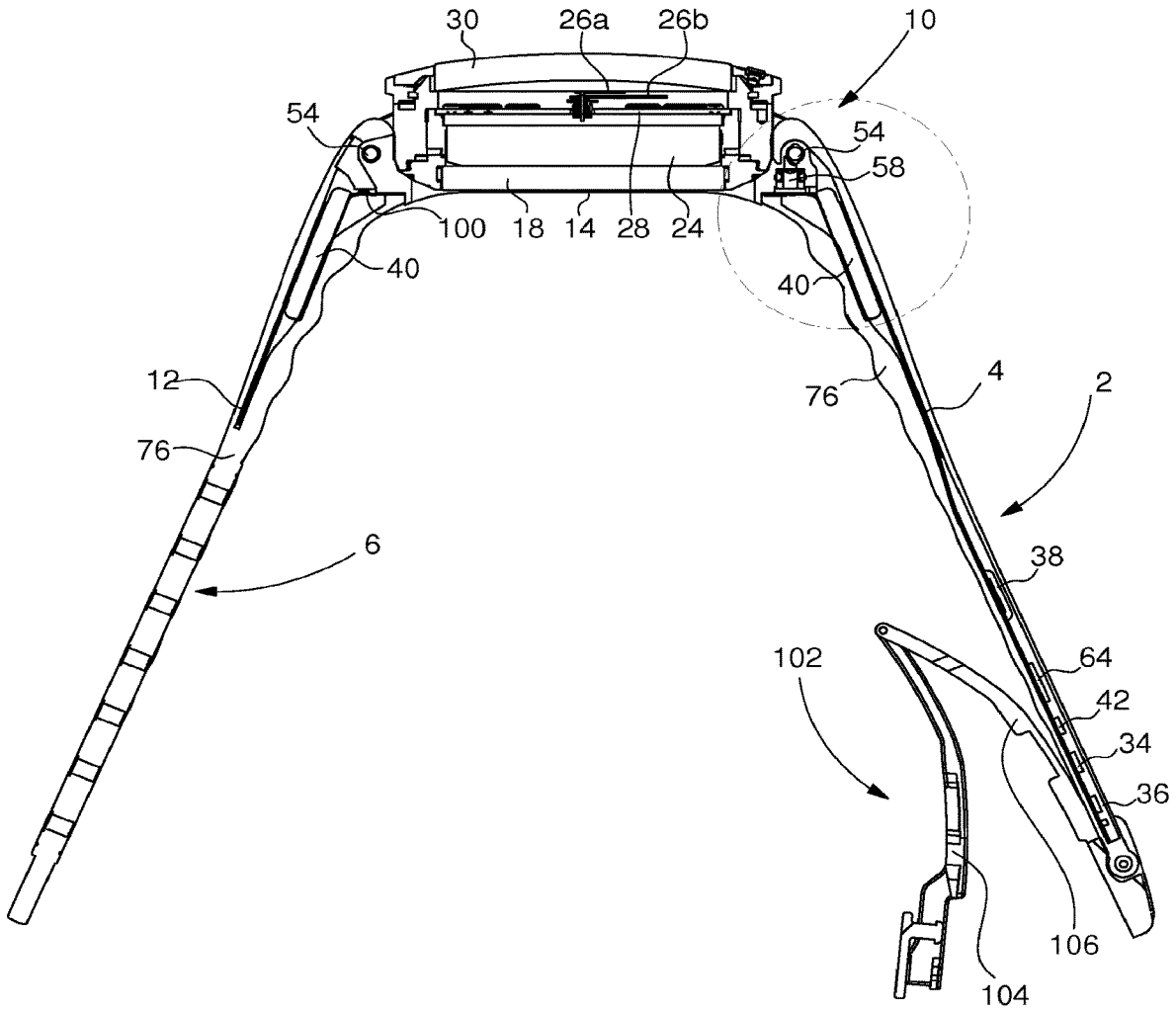
FIG. 12 is a vertical cross-section along the longitudinal axis of the bracelet according to the invention equipped with a deployant buckle clasp, above which is arranged the push-button.

Finally, it will be noted that, according to a second variant embodiment of the invention illustrated in FIG. 12, bracelet 1 is equipped with a folding buckle clasp 102 comprising two strips 104 and 106 pivotally connected to each other and movable between a first unfolded position, in which clasp 102 is open, and a second position corresponding to the closed position of clasp 102, in which strips 104, 106 are folded one over the other. A push-button 64 is arranged in the material of bracelet 1 just above the area of bracelet 1 where the two strips 104, 106 of clasp 102 fold over each other when clasp 102 is closed. The two strips 104, 106 folded one over the other provide a rigid surface offering a support surface which, in response to a pressure exerted on the push-button, exerts a reaction force sufficient to ensure that the pressure exerted on the push-button is not at least partially compensated by corresponding deformation of the bracelet.

Of course, in the case where the rigid support surface is provided by the strips of the deployant buckle clasp, it is not essential for the electrical energy source to be rigid. Within the scope of the present invention, an electrical energy source is only necessary in the case where a push-button is arranged in the bracelet above such an electrical energy source.

NOMENCLATURE

Bracelet 1
First arm 2
First printed circuit board portion 4
Second arm 6
Median part 8
Arches 8*a*, 8*b*
Watch case 10
Second printed circuit board portion 12
Third printed circuit board portion 14
Case middle 16
Case back 18
Insert 20
Stiff ring 22
Watch movement 24
Hour hand 26*a* and minute hand 26*b*
Dial 28
Crystal 30
Microcontroller 34
Accelerometer 36
Magnetic sensor 38
Rigid electrical energy source 40
Integrated circuit 42
Clamp 44
Connecting stud 46
Horns 48
Guide elements 50
Hole 52
Pin 54
Housing 56
Pressure sensor 58
Increase in diameter 60
Sealing gasket 62
Push-button 64
Dome 66
Equidistant arms 68
First contact 70
Peak 72
Second contact 74
Adhesive sheet 75
First overmoulding layer 76
Sleeve 78
First strand 80
Second strand 82
Connecting part 84
Opening 86
Upper band 88
Lower band 90
Peripheral edges 92
Arch portion 94
Notch 96
Transparent light guide 98
Point light source 100
Folding buckle clasp 102
Strips 104 and 106

The invention claimed is:

1. A bracelet or strap for a watch case comprising:

a first arm, inside which is housed a first printed circuit board portion, and a second arm, the first printed circuit board portion carrying at least one electronic component arranged to perform a corresponding electronic function, and an electrical energy source and a microcontroller for powering and controlling the electronic component arranged to perform a corresponding electronic function, at least one pushbutton for inputting a control signal into the microcontroller being arranged inside the bracelet above a rigid surface offering a support surface which, in response to a pressure exerted on the pushbutton, exerts a reaction force sufficient to ensure that the pressure exerted on the pushbutton is not at least partially compensated by corresponding deformation of the bracelet, the first arm being connected to the second arm via a median part arranged to be situated underneath the watch case, a second printed circuit board portion housed inside the second arm and carrying at least one other electronic component being connected to the first printed circuit board portion housed inside the first arm via the median part, which includes a third printed circuit board portion electrically connected to the first and second printed circuit board portions, wherein the first arm and the second arm are formed by the first printed circuit board portion and the second printed circuit board portion and are covered with a first overmoulding layer, wherein an insert that covers the median part and that acts as a seat for the watch case is also covered by the first overmoulding layer, and wherein the insert comprises two guide elements arranged to be placed between two respective pairs of horns carried by the watch case, the guide elements each being pierced with a hole for passage of a pin for attaching the bracelet to the watch case, a housing in which is arranged a pressure sensor being provided in one of the guide elements and opening into the hole for the passage of the corresponding pin, said hole having, on one part of the periphery thereof, a local increase in diameter to allow the pressure sensor to be placed in contact with a surrounding environment, the pressure sensor being mounted on the third printed circuit board portion.

2. The bracelet according to claim 1, wherein the first, second and third printed circuit board portions are made in one piece.

3. The bracelet according to claim 2, wherein the median part includes at least one arch portion.

4. The bracelet according to claim 1, wherein the rigid surface is formed by the electrical energy source.

5. The bracelet according to claim 4, wherein the electrical energy source is a button cell battery.

6. The bracelet according to claim 5, wherein the button cell battery is arranged in an area of connection of the bracelet to the watch case.

7. The bracelet according to claim 1, wherein the push-button consists of a dome-shaped flexible metal sheet, the dome having four equidistant arms bearing on a first contact provided on the first printed circuit board portion, and a peak, which, when the user presses the push-button, deforms and bears on a second contact, also provided on the first printed circuit board portion, which allows a signal to be sent to the microcontroller.

8. A bracelet or strap for a watchcase including comprising:

a folding buckle clasp, a first arm, inside which is housed a first printed circuit board portion, and a second arm, the first printed circuit board portion carrying at least one electronic component arranged to perform a corresponding electronic function, and an electrical energy source and a microcontroller for powering and controlling the electronic component arranged to perform a corresponding electronic function, at least one push-button for inputting a control signal into the microcontroller being arranged inside the bracelet above the folding buckle clasp offering a support surface which, in response to a pressure exerted on the pushbutton, exerts a reaction force sufficient to ensure that the pressure exerted on the pushbutton is not at least partially compensated by corresponding deformation of the bracelet, the first arm being connected to the second arm via a median part arranged to be situated underneath the watch case, a second printed circuit board portion housed inside the second arm and carrying at least one other electronic component being connected to the first printed circuit board portion housed inside the first arm via the median part, which includes a third printed circuit board portion electrically connected to the first and second printed circuit board portions, wherein the first arm and the second arm are formed by the first printed circuit board portion and the second printed circuit board portion and are covered with a first overmoulding layer, wherein an insert that covers the median part and that acts as a seat for the watch case is also covered by the first overmoulding layer, and wherein the insert comprises two guide elements arranged to be placed between two respective pairs of horns carried by the watch case, the guide elements each being pierced with a hole for passage of a pin for attaching the bracelet to the watch case, a housing in which is arranged a pressure sensor being provided in one of the guide elements and opening into the hole for the passage of the corresponding pin, said hole having, on one part of the periphery thereof, a local increase in diameter to allow the pressure sensor to be placed in contact with a surrounding environment, the pressure sensor being mounted on a third printed circuit board portion.

9. The bracelet according to claim 8, wherein the bracelet which is formed of the first and second printed circuit board portions overmoulded by the first overmoulding layer and of the median part covered by the insert, is slipped inside a sleeve formed of a first strand and of a second strand connected to each other by a connecting part, the first and second strands being hollow and each provided with an opening so that the first and second arms can slide therein.

10. The bracelet according to claim 9, wherein the sleeve is formed of an upper band and a lower band joined to each other along peripheral edges thereof.

11. The bracelet according to claim 8, wherein the bracelet is overmoulded with a second layer of plastic or elastomeric material.

12. The bracelet according to claim 8, wherein the first, second and third printed circuit board portions are made in one piece.

13. The bracelet according to claim 12, wherein the median part includes at least one arch portion.

14. The bracelet according to claim 8, wherein the push-button consists of a dome-shaped flexible metal sheet, the dome having four equidistant arms bearing on a first contact provided on the first printed circuit board portion, and a peak, which, when the user presses the push-button, deforms and bears on a second contact, also provided on the first printed circuit board portion, which allows a signal to be sent to the microcontroller.

* * * * *